US007868261B2

(12) United States Patent
Gauzin et al.

(10) Patent No.: US 7,868,261 B2
(45) Date of Patent: Jan. 11, 2011

(54) LOCKING ROCKER SWITCH

(75) Inventors: Joël Gauzin, Montpezat de Quercy (FR); Jean-François Gibert, Caussade (FR); Daniel Duchalet, St. Vincent D'Autejac (FR)

(73) Assignee: APEM (FR)

( * ) Notice: Subject to any disclaimer, the term of this patent is extended or adjusted under 35 U.S.C. 154(b) by 424 days.

(21) Appl. No.: 12/026,987

(22) Filed: Feb. 6, 2008

(65) Prior Publication Data

US 2008/0190746 A1 Aug. 14, 2008

(30) Foreign Application Priority Data

Feb. 8, 2007 (FR) ..... 07 53132

(51) Int. Cl.
*H01H 9/28* (2006.01)

(52) U.S. Cl. ..... 200/43.16

(58) Field of Classification Search ..... 200/43.16, 200/43.17, 43.01, 321, 339
See application file for complete search history.

(56) References Cited

U.S. PATENT DOCUMENTS 4,947,009 A 8/1990 Osika et al.
5,380,964 A 1/1995 Easton et al.
7,468,492 B2 * 12/2008 Lai ..... 200/43.16

FOREIGN PATENT DOCUMENTS

DE 44 22 475 1/1996

* cited by examiner

*Primary Examiner*—James Harvey
*Assistant Examiner*—Vanessa Girardi
(74) *Attorney, Agent, or Firm*—Faegre & Benson LLP

(57) ABSTRACT

The present invention relates to a switch comprising a casing (1, 9), an actuator member (2, 3) pivotably mounted in the casing (1, 9) and integral with a switching control rod (10), capable of occupying a central position (A) and a rocked position (C), a pusher (5) slidably mounted in the actuator member (2, 3) in an incoming/outgoing direction substantially parallel to the plane of symmetry of the rocking, remarkable in that it further comprises a rockably mobile lock (4) on an elastic support (11), said lock (4) being distinct from the pusher (5) and capable of assuming a first position where it is interposed on the trajectory of the actuator member (2, 3) and a second position where it cooperates with the pusher (5) so that a thrust on the pusher (5) urges the lock (4) and allows the latter to disengage from the trajectory of the actuator member (2, 3) towards the rocked position (C).

7 Claims, 5 Drawing Sheets

SECTIONAL A-A

SECTIONAL A-A

SECTIONAL A-A

SECTIONAL A-A

SECTIONAL A-A

SECTIONAL A-A

LOCKING ROCKER SWITCH

FIELD OF THE INVENTION

Figure 1:
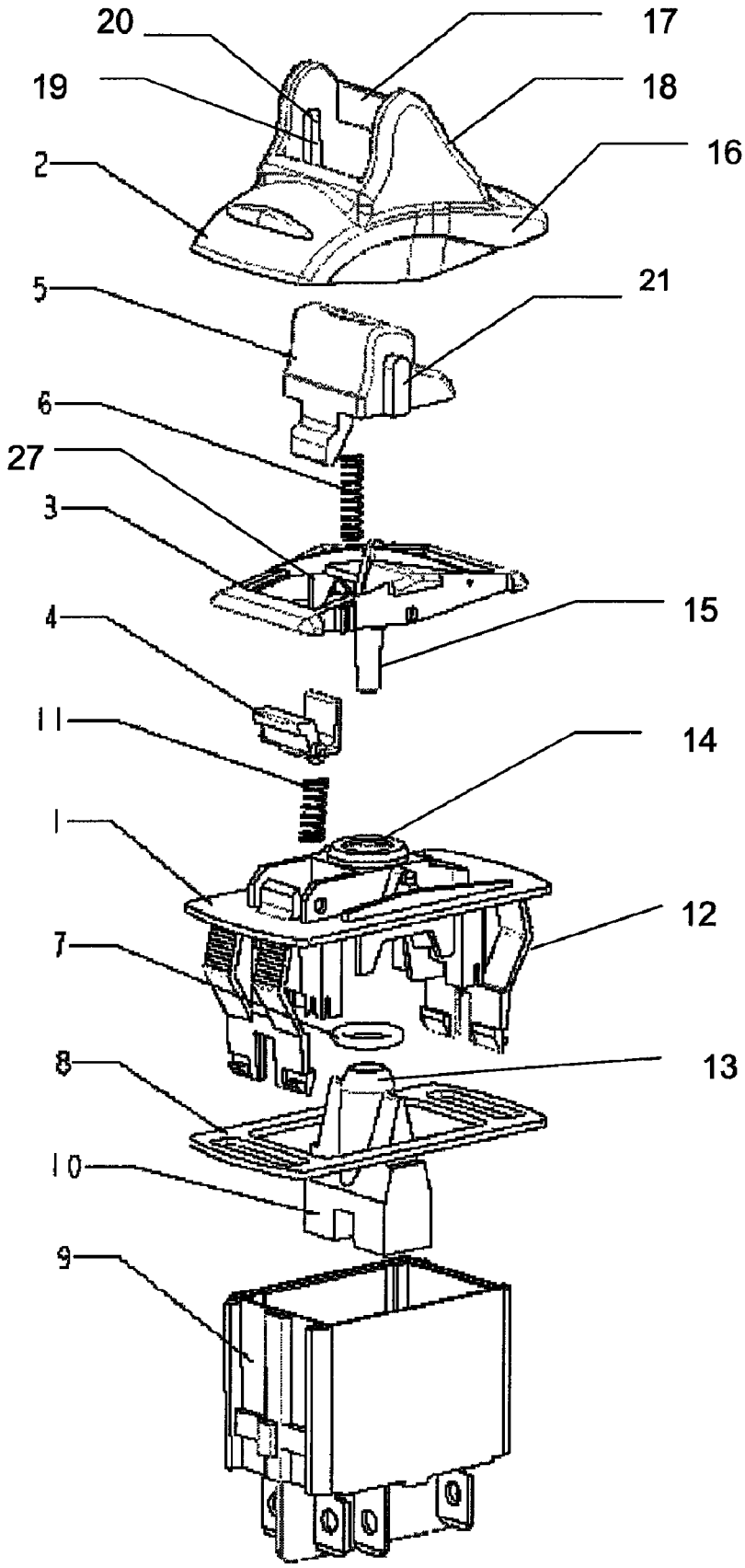

The present invention relates to a manually actuatable rocker switch, at least one of the actuating positions of which is locked.

BACKGROUND OF THE INVENTION

Rocker switches are currently used notably on dashboards of vehicles such as automobiles, public work or agricultural machines, trucks, or any other type of vehicle. Such a switch comprises at least one switching member which provides a sought-after and determined electrical function.

Standard switches may be actuated by applying a limited force on the rocker in a single direction or in both directions. However, with a simple actuation of this type, the switch may be subject to undesired manipulations, since an accidental stress exerted on the rocker may actuate it.

Consequently, in order to reduce the likelihood of an inadvertent actuation, locking systems have been developed so that the switch cannot be actuated without a combination of two movements.

Locking rocker switches such as the one described in U.S. Pat. No. 4,947,009 are thus known. This 3-position switch has an actuator unit provided with a latch capable of sliding in a direction perpendicular to the plane of symmetry of the rocking. In the central position, the latch prevents any pivoting of the actuator unit. In order to actuate the switch in a given direction, the latch needs to be slid in the opposite direction, in order to free an aperture providing a passage for the actuator member, and then to cause the actuator member to pivot in the relevant direction. Now, handling is not intuitive, because the sliding of the latch and rotation of the actuator member require movements in opposite directions. Moreover, the latch needs to be held with two fingers in order to be able to perform the sequence of movements. Actuation of such a switch therefore requires particular attention from the operator which may distract him/her from driving the vehicle.

U.S. Pat. No. 5,380,964 describes a rocker switch, the locking system of which has improved ergonomics. This switch comprises a casing, an actuator unit and a lever which is used for actuating the switch. The casing includes a stop member of the casing, with which cooperates an abutment surface of the lever, in order to prevent rotation in the direction which corresponds to actuation. Unlocking is carried out by pressing on the lever, by which the abutment surface may pass under the abutment member, which frees the rotation of the lever. Actuation is then carried out by pivoting the lever, the latter being kept pushed in. However, the design of this switch is such that the rotation of the lever in the opposite direction to that of actuation is impossible. This switch therefore is only designed for two positions: a central position and a rocked actuation position, and it is impossible to apply the locking system which it uses, to a three-position switch.

Finally, document DE 44 22 475 describes a three-position rocker switch in which an unlocking button, placed at the centre of the actuator member cooperates with a translationally mobile lock in a direction substantially perpendicular to that of the button. The lock is interposed on the trajectory of the actuator member and is released when a pressure is exerted on the unlocking button.

However, because of its central position, the unlocking button does not provide intuitive unlocking because the lock frees both rocking trajectories simultaneously; pressing on the button therefore does not automatically lead to switching.

Further, this button is not protected and may cause untimely unlocking, particularly critical when the switch is intended for risky controls such as for example a force control for a tractor. Indeed, pressing with a large force may lead to unlocking or to deformation of the shaft which may be detrimental to proper operation of the switch—i.e. blocking of the locking or definitive lack of locking.

One of the objects of the invention is therefore to propose a locking rocker switch which may if necessary be used with a three-position switch, with locking for at least one rocked position or for both of them, and which is provided with an ergonomic and intuitive unlocking system. Another object of the invention is to design a switch for which actuation safety is guaranteed and which may support actuating forces without deteriorating the locking system.

SHORT DESCRIPTION OF THE INVENTION

According to the invention, a switch is proposed, comprising:

a casing, an actuator member pivotably mounted in the casing and connected to a switching control rod, capable of occupying a central position and a rocked position, a pusher slidably mounted in the actuator member in an ingoing/outgoing direction substantially parallel to the plane of symmetry of the rocking, the switch further comprising a rockably mobile lock against urging from an elastic support, said lock being distinct from the pusher and capable of assuming a first position where it is interposed on the trajectory of the actuator member, and a second position where it cooperates with the pusher so that a thrust on the pusher urges the lock and allows the latter to disengage from the trajectory of the actuator member towards the rocked position.

According to a particular embodiment, the lock has the general shape of a U, the base of which is urged by the elastic support, a first branch is urged by a finger protruding from the pusher and the other branch is capable of achieving said interposition with the actuator member.

Advantageously, said other branch of the lock cooperates with an aperture in the actuator member.

According to a particular embodiment, the finger extends in a direction substantially parallel to its sliding direction and has an internal face forming a tilted ramp which cooperates with the first branch of the lock so that a thrust on the pusher drives the lock into rotation.

The pusher is advantageously mounted in the actuator member shifted relatively to the pivot axis, so that a thrust on the pusher is capable of driving the actuator member towards the rocked position.

Advantageously, the actuator member is capable of occupying a second rocked position opposite to the rocked position.

According to a particular embodiment of the invention, the switch comprises a second lock capable of cooperating with the pusher and positioned opposite to the first lock relatively to the pivot axis of the actuator member so that a thrust on the pusher urges the first and the second locks and allows the latter to disengage from the trajectory of the actuator member towards one of its rocked positions.

The second lock then advantageously has the general shape of a U, the base of which is urged by an elastic support, a first branch is urged by a finger protruding from the pusher and the other branch is capable of being interposed on the trajectory of the actuator member.

Preferably, the pusher is slidably mounted between two walls of the actuator member, said walls forming protective cheeks with regard to untimely unlocking.

SHORT DESCRIPTION OF THE DRAWINGS

Figure 2:
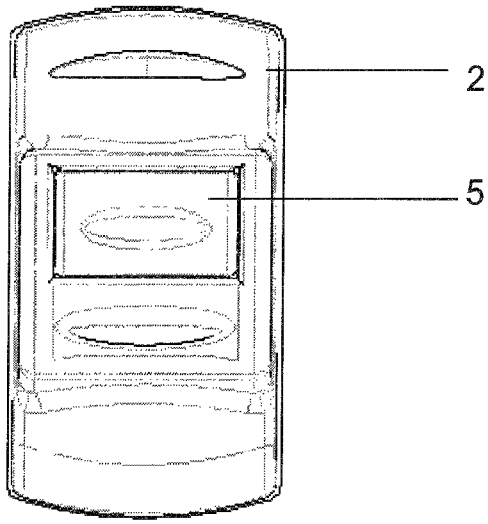
Figure 3:
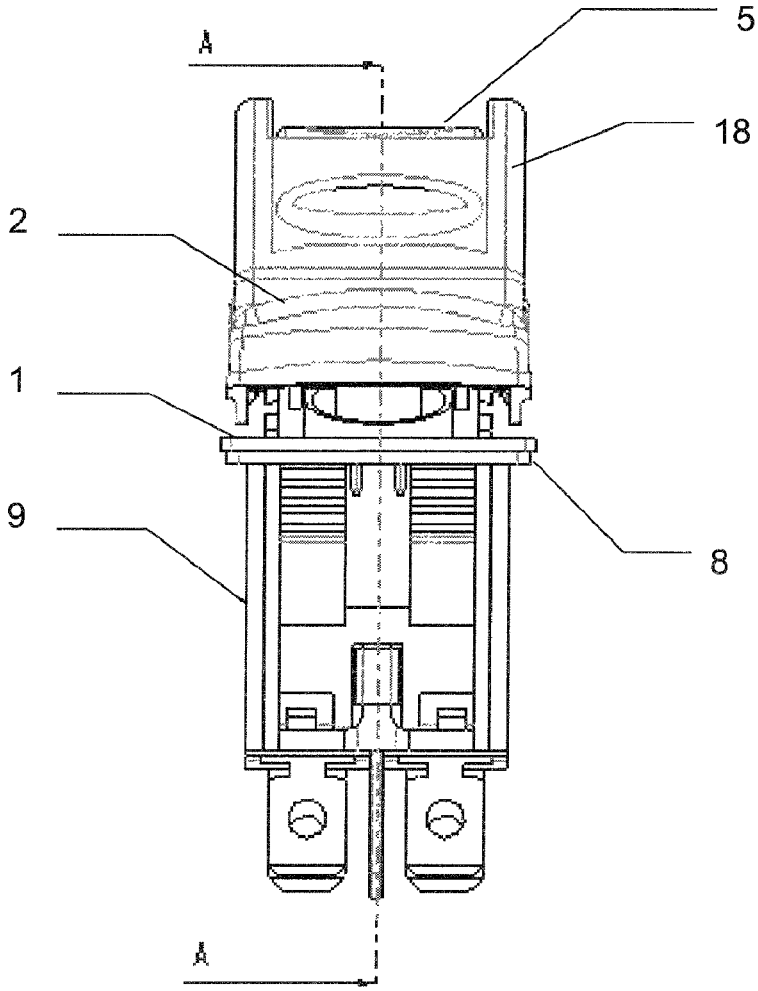
Figure 4:
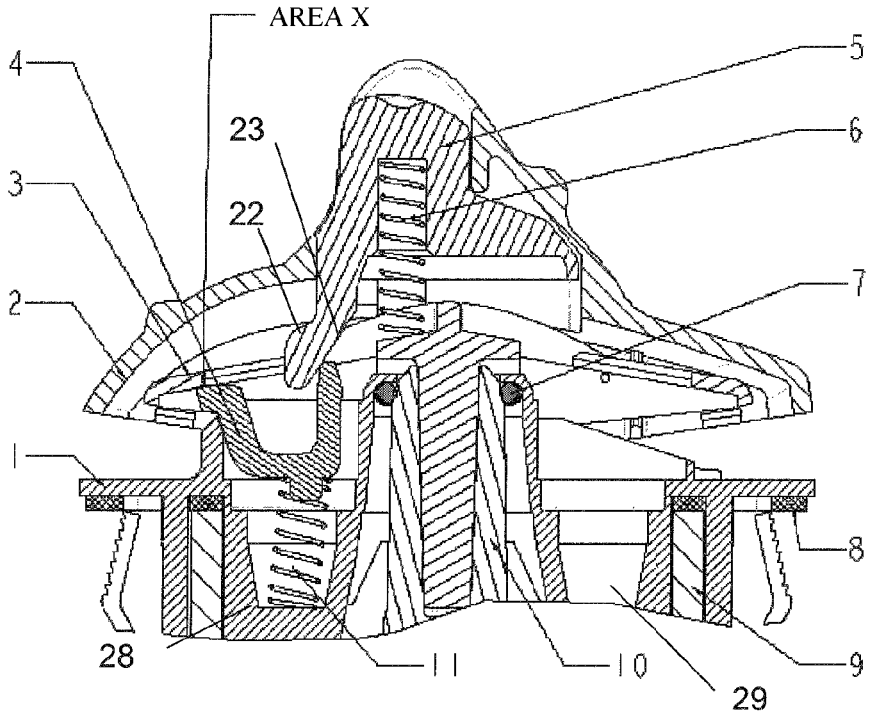
Figure 5:
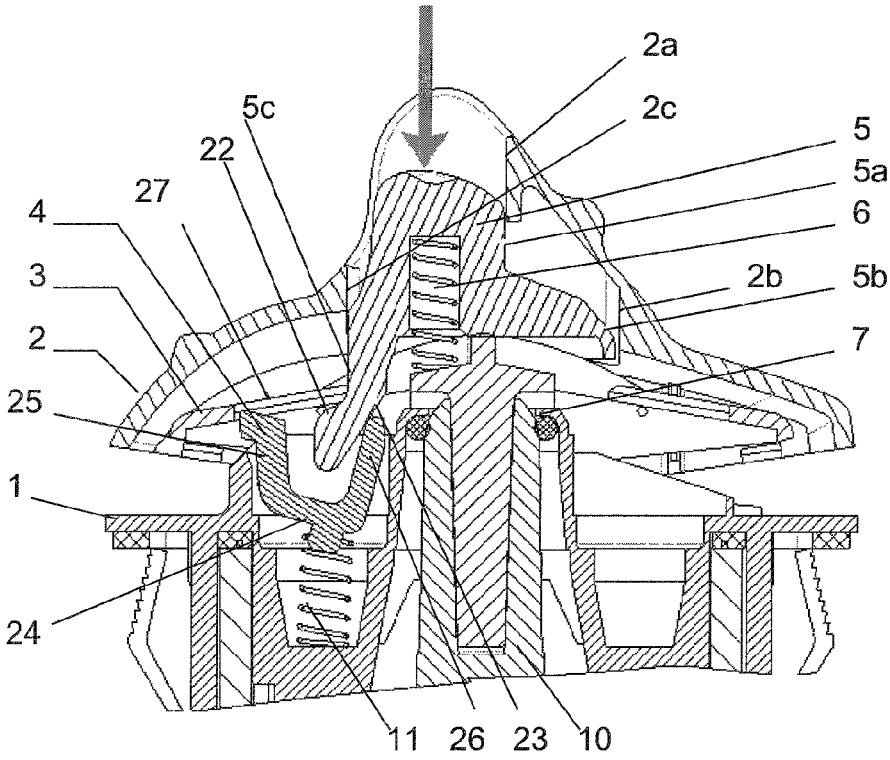
Figure 6:
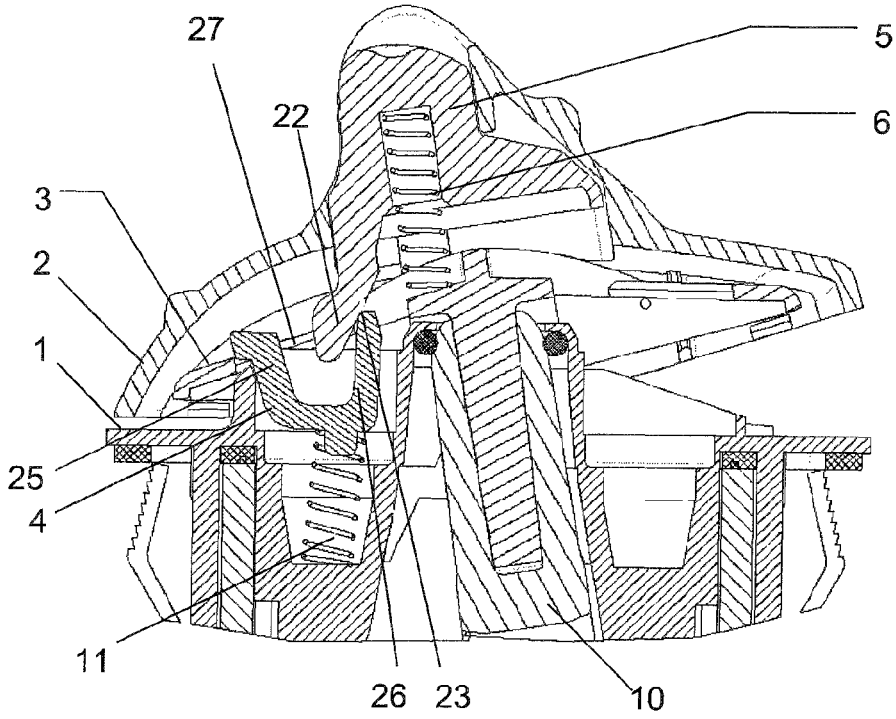
Figure 7:
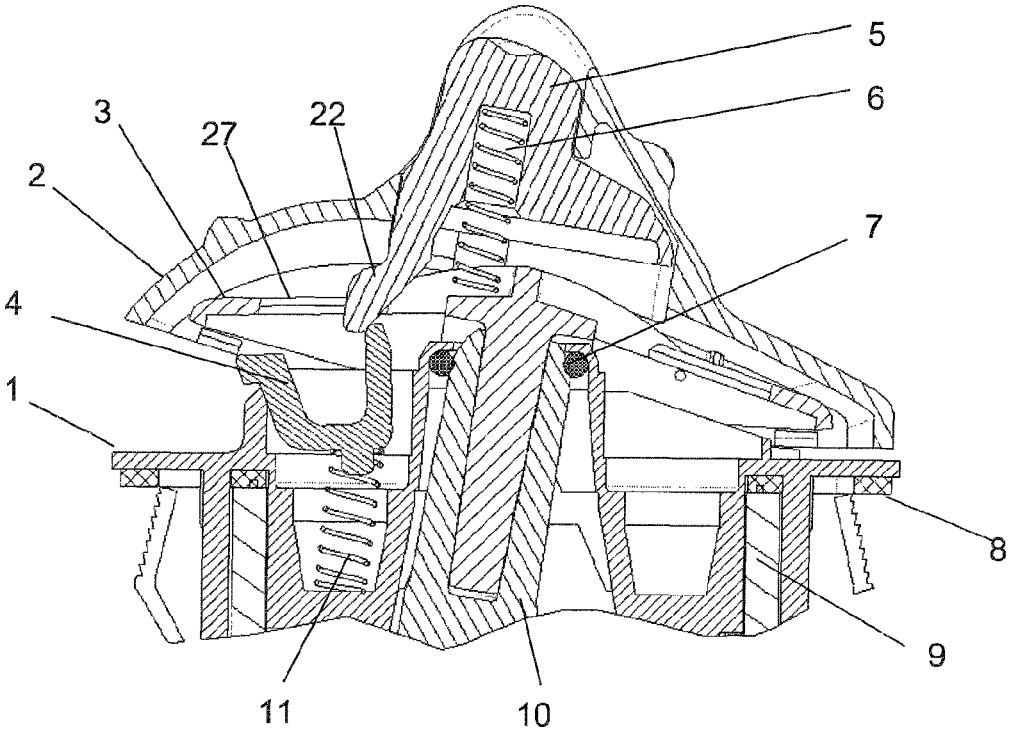
Figure 8:
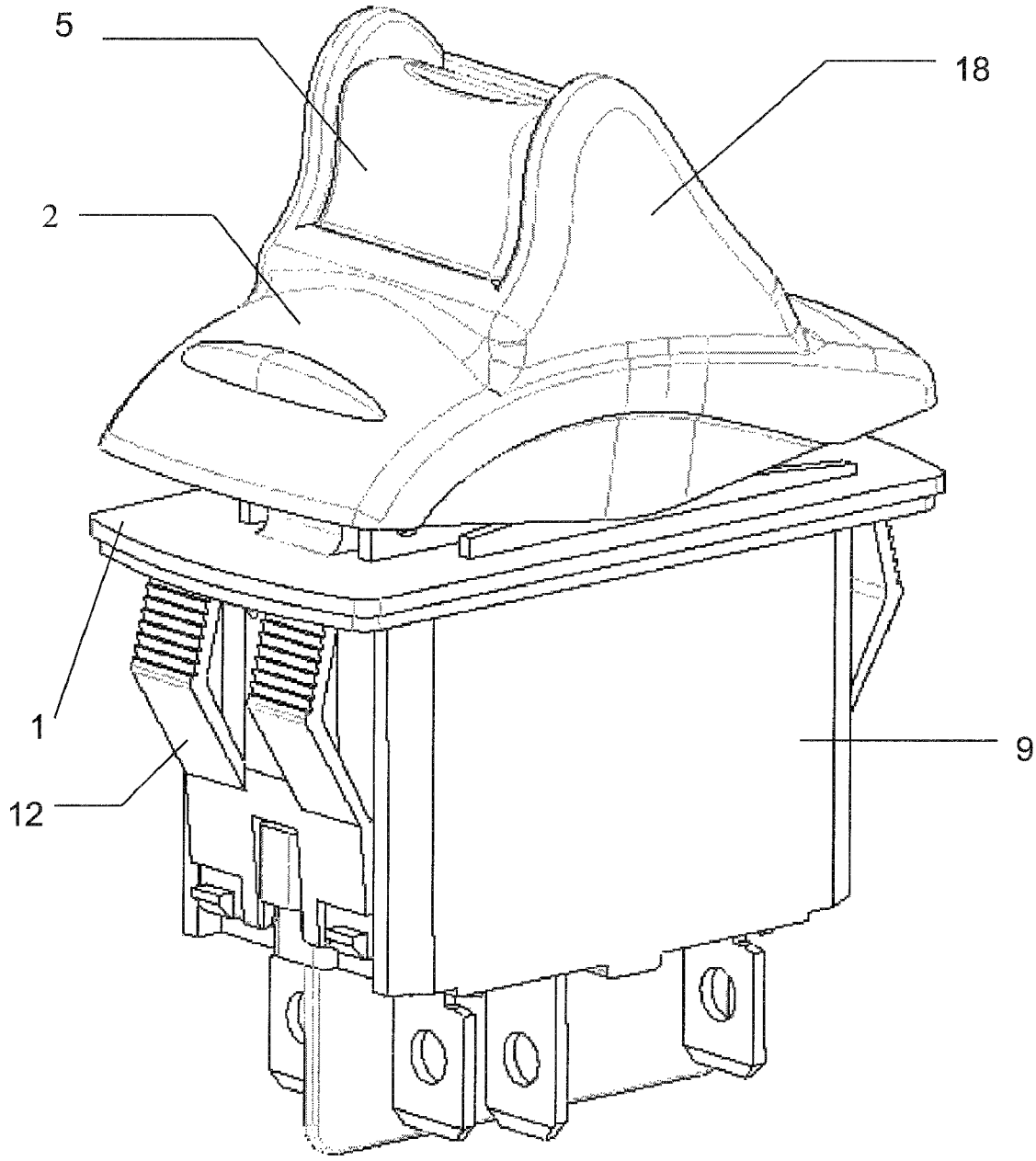

The invention will be better understood and other advantages and features will become better apparent from the following description of an embodiment, given as a non-limiting example, of the switch according to the invention, from the appended drawings wherein:

FIG. 1 is a perspective exploded view of the switch according to the invention, FIG. 2 is a top view of the assembled switch, FIG. 3 is a side view of the assembled switch, FIG. 4 is a front partial sectional view along the sectional plane A-A illustrated in FIG. 3, of the switch in position A, FIG. 5 is a front partial sectional view along A-A of the switch in position A, the pusher being actuated, FIG. 6 is a front partial sectional view along A-A of the switch in position C, FIG. 7 is a front partial sectional view along A-A of the switch in position B, FIG. 8 is an isometric view of the assembled product.

DETAILED DESCRIPTION OF THE INVENTION

With reference to FIG. 1, the switch has a body 9 forming a switch casing, on which a front plate 1 is assembled by means of elastic tabs 12. The body and the front plate are made by molding customary synthetic materials, such as polyamide for example. The seal between the body 9 and the front plate 1 is provided by a gasket 8.

The internal components of the switch, such as switching members, mechanical units, output terminals, are well-known to one skilled in the art and will not be described in detail. Notably the switch has at least one switching member (not shown) capable of being actuated under the action of a switching rod 10 for achieving the desired electrical contact.

The upper portion of the switching rod 10 has a conical shape 13 which cooperates with a circular aperture 14 in the front plate 1 in order to allow rocking of said rod 10. The seal between the switching rod 10 and the front plate 1 is provided by an O-ring 7.

Moreover, an actuator member consists of a rocker 2 and a rocker support 3. The rocker 2 and the rocker support 3 are made by molding customary synthetic materials, such as polyamide for example, and may be assembled by snapping the rocker support 3 into the rocker 2, so that, when the switch is assembled, only the rocker 2 is visible.

The actuator member 2, 3 is pivotably mounted on the front plate 1 around a transverse axis perpendicular to the plane of FIG. 4. The actuator member 2, 3 is capable of adopting two rocked positions on either side of a central equilibrium position.

The rocker 2 appears as a convex shell comprising a base 16 and an upper portion extending perpendicularly to the base and allowing the rocker to be grasped. The upper portion has an aperture 17 with a substantially rectangular shape defined by two parallel walls 18, which are perpendicular to the pivot axis of the actuator member.

The inner face of each wall 18 includes a notch 19 substantially perpendicular 16 of the rocker, and which extends towards the base from a point 20 which forms an upper stop.

The rocker support 3 has the general shape of a frame, which, in its middle portion, includes a finger 15 which extends perpendicularly to the latter.

Two apertures 27 of substantially rectangular shape are found on either side of the middle portion of the rocker support 3.

The rocker support 3 is made integral with the switching rod 10 via the finger 15 which is inserted in a corresponding well inside said rod 10.

A pusher 5 is slidably mounted in the actuator member 2, 3, by means of two ribs 21 located on its side faces and capable of sliding in the notches 19. Guiding of the pusher 5 is moreover provided by surfaces 5*a*, 5*b*, 5*c* capable of sliding inside corresponding surfaces 2*a*, 2*b*, 2*c* of the rocker 2 (see FIG. 5). A return spring 6 is capable of bringing the pusher 5 back into the emerging position against the stops 20. The other end of the spring 6 is inserted into a housing in the rocker support 3 in proximity to the pivot axis.

The upper portion of the pusher emerges from the aperture 17 so that an operator may push it in with a finger. However, the walls 18 fulfill a function of protective cheeks, while preventing untimely unlocking induced by accidental pressure exerted on the pusher 5.

The pusher 5 moreover has a finger 22 which extends along a direction substantially parallel to its sliding direction towards the front plate 1. The internal face of the finger 22 forms a ramp 23 tilted outwards relatively to said sliding direction.

Finally, a lock 4, having the general shape of a U, defining two branches, is mounted so as to be rockably mobile against urging at its base 24 from an elastic support 11 mounted inside a cavity 28 in the front plate 1, on the same side relatively to the pivot axis as the spring 6. According to a particular embodiment, the elastic support 11 is a spring.

With reference to FIGS. 4 and 5, one of the branches 25 of the lock 4 is capable of being interposed on the trajectory of the actuator member at an area X located under the rocker support 3, so as to prevent rotation of the rocking member 2, 3. The area X is located at the edge of the aperture 27, on the furthest side of the pivot axis. The width of the branch 25 (considered in a direction parallel to the pivot axis) is smaller than that of the aperture 27 of the rocker support.

The other branch 26 of the lock 4 cooperates with the finger 22 of the pusher 5 along the ramp 23.

The operation of a switch according to the invention and the hand operations required for actuating it will now be described.

The switch accepts three positions: a central position A, which is the equilibrium position, illustrated in FIG. 4, and two rocked positions B and C on either side of the position A, illustrated in FIGS. 7 and 6 respectively. In the described example, position B is attained by rocking in the clockwise direction in the figures, and position C by rocking in the anticlockwise direction in the figures.

In this embodiment, the described locking device only acts in the actuation direction from position A to position C.

As this is seen in FIGS. 4 and 7, the lock does not form an obstacle to rocking the actuator member from position A to position B. An operator may therefore freely bring the switch from position A to position B.

With reference to FIG. 4, which illustrates the switch in position A, the branch 25 of the lock 4 is in contact with the rocker support 3 at the area X, so that it prevents rotation of the rocking member 2, 3 in the anticlockwise direction towards position C.

With reference to FIG. 5, the other branch 26 of the lock 4 cooperates with the finger 22 of the pusher 5 along the ramp 23, so that when the pusher 5 is pushed in, the spring 11 is compressed and the lock 4 is driven into rotation in the clockwise direction in the figure, which releases the rocker support 3 in the X area.

The branch 25 of the lock 4 is then positioned inside the aperture 27 which is wider and which therefore does not oppose rocking of the actuator member 2, 3 in the anticlockwise direction in the figure.

With reference to FIG. 6, the operator may then bring the switch to position C by rocking the actuator member without releasing its pressure on the pusher 5. In this respect and as this was seen above, the pusher 5 is mounted in the actuator member shifted from the pivot axis, on the same side relatively to this axis as the lock 4. Thus, a thrust on the pusher 5 is capable of driving the actuator member towards the rocked position C.

Rocking the rocker support 3 then drives the switching rod 10 into rotation, which actuates the switching member.

It is interesting to note that this chain of operations may be performed with a single finger. Further, unlocking promotes rocking of the actuator member towards the desired position. The locking switch according to the invention is therefore particularly ergonomic.

Thus, as actuation results from the combination of two movements, any risk of accidental actuation of the switch is avoided, but, because of its kinematics, actuation remains intuitive and may be performed by the operator rapidly and without requiring prolonged attention on his/her behalf.

When the pressure is released on the pusher 5, the latter moves upwards under the action of return spring 6, and the lock 4 begins to pivot towards its initial position under the action of the spring 11, without however locking the device.

The return of the switch to the position A (FIG. 4) allows the end of rotation of the lock 4 which will be housed under the rocker support 3 in the area X. The switch is therefore again locked in position A.

According to an alternative of the invention, advantage of the general symmetry of the assembly relatively to the central position A may be taken in order to create locking also in the second actuation direction (from position A to position B).

For this purpose, a second lock and a second elastic support 30 are installed in another cavity 29 (see FIG. 4) of the front plate 1 of the switch already described. This second lock and this second elastic support 30 are positioned opposite to the first lock 4 and to the first elastic support 11 relatively to the pivot axis of the actuator member 2, 3. Further, a pusher is used which includes a second finger which cooperates with the second lock. The second lock has the general shape of a U, the base of which is urged by the second elastic support 30, a first branch is urged by the second finger of the pusher, and the other branch is capable of being interposed on the trajectory of the actuator member 2, 3 towards position B.

Thus, in position A, the first lock 4 prevents rocking of the actuator member 2, 3 towards position C, whereas the second lock prevents rocking from position A to position B.

A pressure on the pusher urges the first lock and the second lock and allows the latter to disengage from the trajectory of the actuator member 2, 3.

By maintaining his/her pressure on the pusher 5, the operator may then rock the actuator member 2, 3 towards the desired actuation position B or C.

A switch with a dual locking device is thereby obtained.

Finally, it is obvious that the examples which have just been given are only particular illustrations and by no means limiting as regards the embodiments and fields of application of the invention.

The invention claimed is:

1. A switch comprising:

a casing;

an actuator member pivotably mounted in the casing and connected to a switching control rod, the actuator member configured to rock between a central position (A) and a rocked position (C);

a pusher slidably mounted in the actuator member; and a rockably mobile lock on an elastic support, said lock being distinct from the pusher and being configured to assume a first position where the lock is interposed between the actuator member and the casing and a second position where the lock cooperates with the pusher so that a push on the pusher urges the lock and allows the lock to disengage from between the actuator member and the casing (2, 3) towards the rocked position (C).

2. The switch according to claim 1, wherein the pusher is mounted in the actuator member such that a push on the pusher is able to drive the actuator member towards the rocked position (C).

3. The switch according to claim 1, wherein the actuator member is configured to occupy a second rocked position (B) opposite to the rocked position (C).

4. The switch according to claim 1, wherein the pusher is slidably mounted between two walls of the actuator member, said walls forming protective cheeks preventing untimely unlocking.

5. The switch according to claim 1, wherein the lock has the general shape of a U having a base that is urged by the elastic support, a first branch that is urged by a finger protruding from the pusher and another branch configured to interact with the actuator member.

6. The switch according to claim 5, wherein the other branch of the lock cooperates with an aperture in the actuator member.

7. The switch according to claim 5, wherein the finger extends in a direction substantially parallel to its sliding direction and has an internal face forming a tilted ramp which cooperates with the first branch of the lock so that a push on the pusher drives the lock into rotation.

* * * * *